US007828488B2

(12) United States Patent
Matsuoka

(10) Patent No.: US 7,828,488 B2
(45) **Date of Patent: *Nov. 9, 2010**

(54) DEVELOPING APPARATUS, DEVELOPING METHOD, COATING AND DEVELOPING SYSTEM AND STORAGE MEDIUM

(75) Inventor: Nobuaki Matsuoka, Koshi (JP)

(73) Assignee: Tokyo Electron Limited, Tokyo-To (JP)

( * ) Notice: Subject to any disclaimer, the term of this patent is extended or adjusted under 35 U.S.C. 154(b) by 242 days.

This patent is subject to a terminal disclaimer.

(21) Appl. No.: 12/105,701

(22) Filed: Apr. 18, 2008

(65) Prior Publication Data

US 2008/0267619 A1 Oct. 30, 2008

(30) Foreign Application Priority Data

Apr. 27, 2007 (JP) ..... 2007-119506

(51) Int. Cl.
*G03D 5/00* (2006.01)

(52) U.S. Cl. ..... 396/611; 396/604

(58) Field of Classification Search ..... 396/611
See application file for complete search history.

(56) References Cited

U.S. PATENT DOCUMENTS 7,241,061 B2 * 7/2007 Akimoto et al. ..... 396/611
2005/0271382 A1 * 12/2005 Ogata et al. ..... 396/611
2006/0040051 A1 2/2006 Yamamoto et al.
2007/0065145 A1 3/2007 Kitamura
2008/0241403 A1 * 10/2008 Matsuoka et al. ..... 427/331
2008/0268383 A1 * 10/2008 Matsuoka et al. ..... 430/324

FOREIGN PATENT DOCUMENTS

JP 2005-210059 8/2005
JP 2006-60084 3/2006

* cited by examiner

*Primary Examiner*—Rodney E Fuller
(74) *Attorney, Agent, or Firm*—Oblon, Spivak, McClelland, Maier & Neustadt, L.L.P.

(57) ABSTRACT

A developing apparatus includes two rotating members respectively having parallel horizontal axes of rotation and disposed longitudinally opposite to each other, a carrying passage forming mechanism extended between the rotating members to form a carrying passage, and capable of moving along an orbital path to carry a wafer supported thereon along the carrying passage, a sending-in transfer unit disposed at the upstream end of the carrying passage, a sending-out transfer unit disposed at the downstream end of the carrying passage, a developer pouring nozzle for pouring a developer onto the wafer, a cleaning nozzle for pouring a cleaning liquid onto the wafer, and a gas nozzle for blowing a gas against the wafer. The developer pouring nozzle, the cleaning nozzle and the gas nozzle are arranged in that order in a direction in which the wafer is carried along the carrying passage.

15 Claims, 11 Drawing Sheets

DEVELOPING APPARATUS, DEVELOPING METHOD, COATING AND DEVELOPING SYSTEM AND STORAGE MEDIUM

BACKGROUND OF THE INVENTION

1. Field of the Invention

The present invention relates to a developing apparatus and a developing method for processing a substrate, such as a semiconductor wafer W or a LCD substrate, namely, a glass substrate for a liquid crystal display, having a surface coated with a resist and processed by an exposure process by a developing process, a coating and developing system, and a storage medium.

2. Description of the Related Art

A manufacturing process for manufacturing a semiconductor device or an LCD substrate forms a resist patter on a substrate by photolithography. Photolithography includes a series of steps of coating a surface of a substrate, such as a semiconductor wafer (hereinafter, referred to as "wafer") with a resist film by applying a resist solution to the surface, exposing the resist film to light through a photomask, and processing the exposed resist film by a developing process to form a desired pattern. Generally, those processes are carried out by a resist pattern forming system built by connecting a coating and developing system that carries out a resist solution application process and a developing process, and an exposure system.

Referring to FIG. 12, a known developing apparatus disclosed in JP-A 2005-210059 has a vertically movable, rotating spin chuck 1 for horizontally supporting a wafer W thereon, and a developer pouring nozzle 11 disposed above a wafer W supported on the spin chuck and provided with a small pouring pore. Shown in FIG. 12 are a cup 12, a liquid container 13 and a drain port 14. As mentioned in JP-A 2006-60084, the developer pouring nozzle 11 is moved radially relative to a wafer W being rotated about a vertical axis to wet the surface of the wafer W by pouring the developer onto the wafer W in a spiral bead of the developer. The wafer W wetted with the developer is processed by a stationary developing process for a predetermined time of, for example, 60 s, and then a rinsing liquid, such as pure water, is poured through a rinsing nozzle 15 onto a central part of the upper surface of the wafer W. Thus, parts, insoluble in the developer, of the resist film remain on the wafer W in a resist pattern.

A known developing apparatus pours a developer onto a surface of a wafer W through a developer pouring nozzle having outlet opening of a length corresponding to the diameter of the wafer W, rotates the wafer W half a turn about a vertical axis to spread the developer over the surface of the wafer W. Another known developing apparatus pours a developer onto a surface of a wafer W through a developer pouring nozzle having outlet opening of a length corresponding to the diameter of the wafer W, and moves the developer pouring nozzle horizontally relative to the wafer W to spread the developer over the surface of the wafer W.

The further improvement of the throughput of the developing apparatus is desired to improve the throughput of the coating and developing system including the developing apparatus. Overhead time, namely, time needed by work other than a developing process by which a wafer W is processed and a cleaning process using a rinsing liquid, needs to be further curtailed to improve the throughput of the developing apparatus. Reduction of time needed by a substrate carrying device for transferring a wafer W to the developing apparatus and for receiving a wafer W processed by the developing device from the developing apparatus may be effective in improving the throughput of the developing apparatus. Nothing is mentioned about such measures in IP-A 2005-210059 and JP-A 2006-60084.

SUMMARY OF THE INVENTION

The present invention has been made under such circumstances and it is therefore an object of the present invention to provide techniques for improving the throughput of a developing apparatus.

The present invention provides a developing apparatus, to which a substrate carrying means delivers a substrate coated with a solution, processed by an exposure process and to be processed by a developing process, including: a pair of rotating members disposed longitudinally opposite to each other such that the respective axes of rotation thereof are parallel to each other and horizontal; a carrying passage forming mechanism extended between the pair of rotating members so as to move along an orbital path and forming a carrying passage along which a substrate placed thereon is carried; a sending-in transfer unit disposed at an upstream end of the carrying passage to transfer a substrate from the substrate carrying means to the carrying passage forming mechanism; a sending-out transfer unit disposed at a downstream end of the carrying passage to transfer a substrate from the carrying passage forming mechanism to the substrate carrying means; and a developer pouring nozzle for pouring a developer onto a substrate, a cleaning nozzle for pouring a cleaning liquid onto a substrate and a gas nozzle for blowing a gas against a substrate arranged in that order in a direction in which a substrate mounted on the carrying passage forming mechanism moves.

The carrying passage forming mechanism may include a plurality of bar-shaped carrying members extended parallel to the axes of rotation of the rotating members to support a substrate thereon, and a pair of timing belts connected to the opposite ends of each of the carrying members, respectively, and movable along the orbital path. The developing apparatus may include a motor for driving at least one of the pair of rotating members for rotation to move the timing belts along the orbital path.

The timing belts of the carrying passage forming mechanism may be provided at least in their outer surfaces with electromagnets arranged such that N poles and S poles are arranged alternately, and driving electromagnets having changeable magnetic properties for moving the timing belts along the orbital path may be arranged such that N poles and S poles are arranged alternately. The timing belts are driven by the driving electromagnets in a contactless driving model. A mesh belt capable of moving in synchronism with the movement of a substrate on the carrying passage may be extended between a substrate on the carrying passage and the developer pouring nozzle.

The present invention provides a coating and developing system including: a carrier block to which a carrier containing a plurality of substrates is delivered and from which a carrier containing a plurality of substrates is sent out; a processing block including coating units for coating a surface of a substrate with a resist solution, heating units for heating a substrate, cooling units for cooling a heated substrate, and developing units for processing a substrate processed by an exposure process by a developing process; an interface block through which a substrate is transferred between the processing block and an exposure system; wherein each of the developing units includes the developing apparatus of the present invention.

The present invention provides a developing method of processing a substrate having a surface coated with a solution and processed by an exposure process and carried by a substrate carrying means by a developing apparatus including the steps of: forming a substrate carrying passage along which a substrate supported on a carrying passage forming mechanism extended between a pair of rotating members disposed longitudinally opposite to each other with their axes of rotation extended parallel to each other, and movable along an orbital path is carried; transferring a substrate from the substrate carrying means through a sending-in transfer unit disposed at an upstream end of the carrying passage to the carrying passage forming mechanism; pouring a developer onto the substrate while the substrate is being moved downstream by moving the carrying passage forming mechanism; pouring a cleaning liquid onto the substrate while the substrate is being moved downstream by the carrying passage forming mechanism; blowing a dry gas against the substrate while the substrate is being moved downstream by the carrying passage forming mechanism; transferring the substrate from the carrying passage forming mechanism through a sending-out transfer unit disposed at a downstream end of the carrying passage to the substrate carrying means; and moving the carrying passage forming mechanism not supporting any substrate from the sending-out transfer unit to the sending-in transfer unit along the orbital path.

The present invention provides a storage medium storing a computer program to be executed by a developing apparatus that processes a substrate having a surface coated with a solution and processed by an exposure process by a developing process; wherein the computer program is a set of instructions specifying the steps of the developing method.

According to the present invention, substrates are transferred successively from the substrate carrying means to the sending-in transfer unit, the substrates are carried successively downstream along the carrying passage, the substrates are processed successively by a developing process, a cleaning process and a drying process while the substrates are being carried along the carrying passage, and the substrates processed by all those processes are transferred successively through the sending-out transfer unit to the substrate carrying means. Thus the developing apparatus of the present invention can process substrates by the developing process in a flow processing mode and can process a plurality of substrates continuously by the developing process. Therefore, the developing apparatus can achieve a high throughput. The substrate carrying means of the developing apparatus can access two parts, namely, the sending-in transfer unit and the sending-out transfer unit, load on the substrate carrying means is small, which improves the throughput.

DESCRIPTION OF THE PREFERRED EMBODIMENTS

Figure 1:
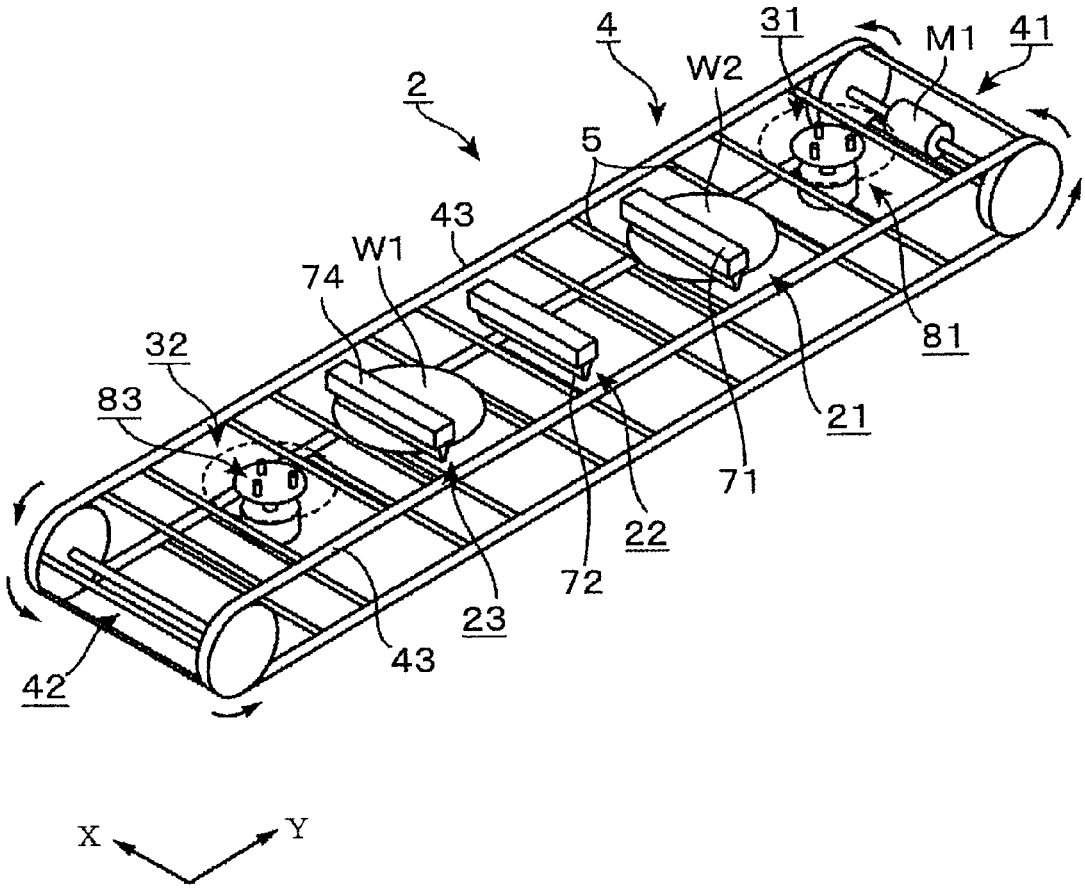
FIG. 1 is a schematic perspective view of a developing apparatus in a first embodiment according to the present invention.
Figure 2:
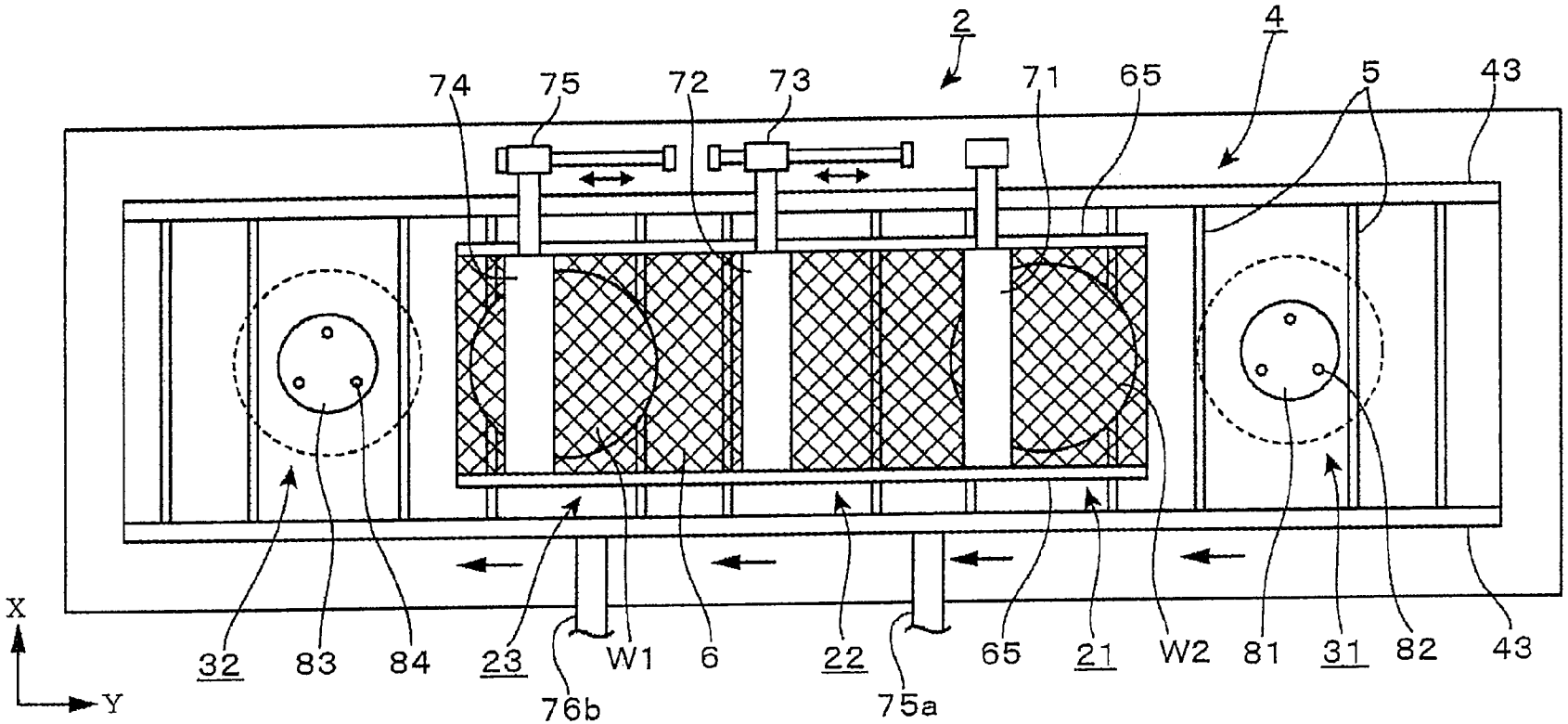
FIG. 2 is a plan view of the developing apparatus shown in FIG. 1.
Figure 3:
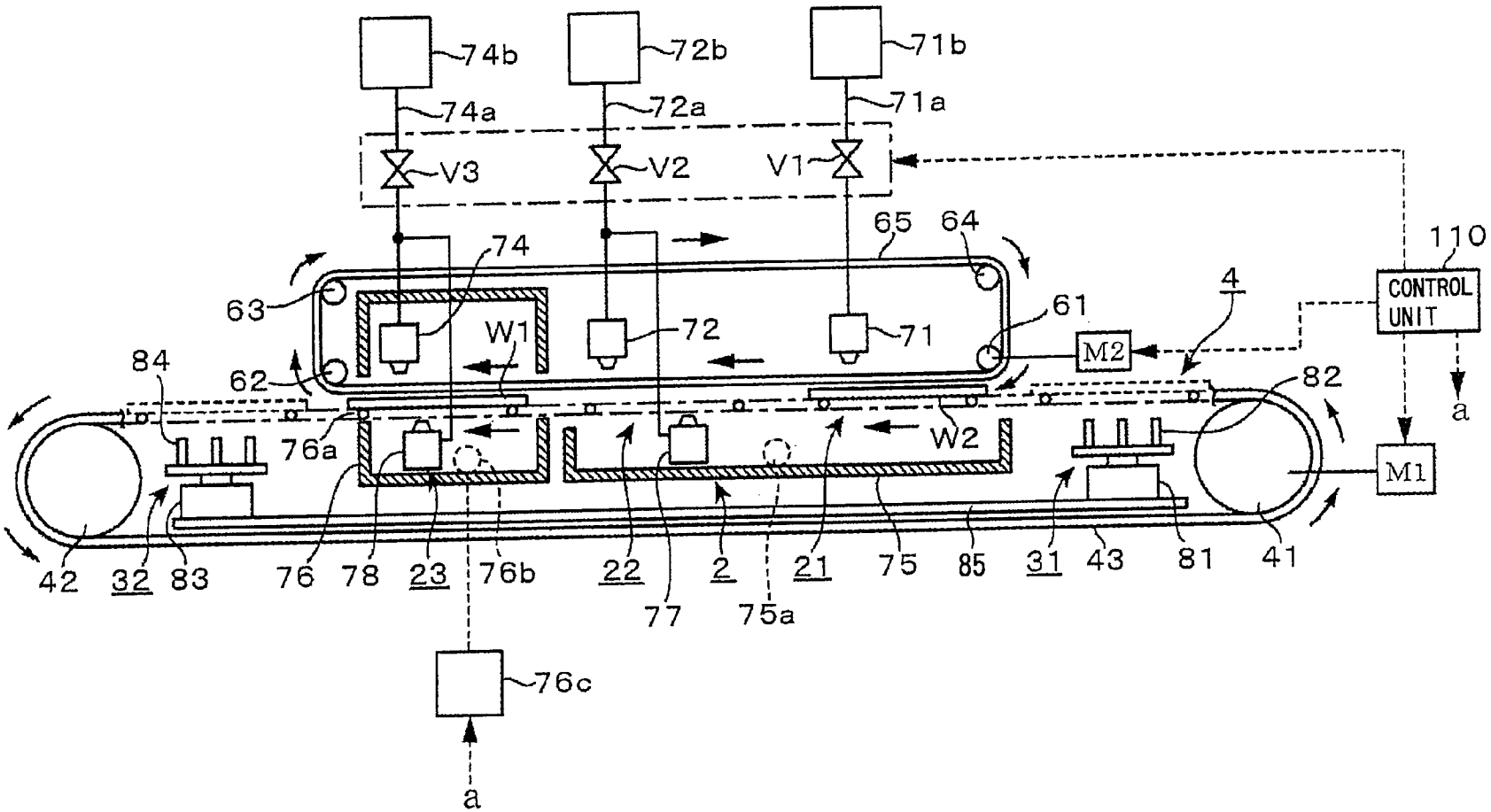
FIG. 3 is a side elevation of the developing apparatus shown in FIG. 1.

A preferred embodiment of the present invention will be described with reference to the accompanying drawings. FIG. 1 is a schematic perspective view of a developing apparatus in the preferred embodiment, FIG. 2 is a plan view of the developing apparatus, and FIG. 3 is a side elevation of the developing apparatus. The developing apparatus has a processing area 2, a sending-in transfer unit 31 disposed at one of the opposite ends of the processing area 2 with respect to the length of the processing area 2, a sending-out transfer unit 32 disposed at the other end of the processing area 2 with respect to the length of the processing area.

The processing area 2 has a length long enough to longitudinally arrange, for example, three wafers W along the length of the processing area 2 extending in a Y-direction, and has a width, namely, a dimension in an X-direction, suitable for processing a wafer W by a developing process. Suppose that the side of the sending-in transfer unit 31 is an upstream side, and the side of the sending-out transfer unit 32 is a downstream side. Then, a developing area 21, a cleaning area 22 and a drying area 23 are arranged in the processing area 2 in that order in a direction from the upstream side toward the down stream side. Each of the developing area 21, the cleaning area 22 and the drying area 23 has a length suitable for placing, for example, a wafer W therein.

A carrying passage forming mechanism 4 supports a wafer W thereon and carries the wafer W in the processing area 2 from the upstream side toward the downstream side. The carrying passage forming mechanism 4 is extended between a pair of rotating members 41 and 42 respectively having parallel horizontal axes of rotation. The carrying passage forming mechanism 4 turn along an orbital path. The carrying passage forming mechanism 4 a carrying passage More concretely, the carrying passage forming mechanism 4 includes a pair of timing belts 43 wound round the rotating members 41 and 42 so as to move along the orbital path, and a plurality of bar-shaped carrying members 5 extended parallel to the axes of rotation and each having opposite ends attached to the timing belts 43, respectively. The timing belts 43 are wound around the rotating members 41 and 42.

Figure 4:
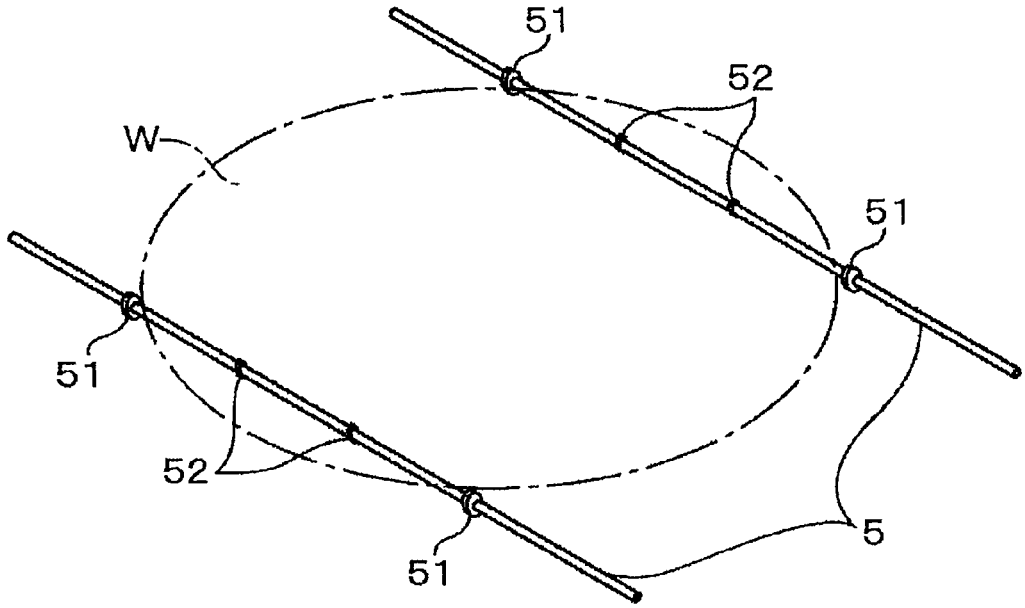
FIG. 4 is a perspective view of carrying members included in the developing apparatus shown in FIG. 1.

As shown in FIG. 4 by way of example, the carrying members 5 are bars of a ceramic material or a resin, such as a polytetrafluoroethylene resin, having a circular cross section or a polygonal cross section, such as a triangular cross section. The carrying members 5 have a length substantially corresponding to the width of the processing area 2 as shown in FIG. 1. When the carrying members 5 have a circular cross section, the diameter of the carrying members 5 is on the order of 7 mm. In this embodiment, a wafer W is supported on the two carrying members 5 with peripheral parts of its back surface in contact with the carrying members 5.

The carrying members 5 are provided with guide members 51 of, for example, a polytetrafluoroethylene resin. When a wafer W is transferred from an external substrate carrying device shown in FIG. 6A to the carrying members 5, the guide members 51 adjacent to the circumference of the wafer W prevent the dislocation of the wafer W from a correct position. The carrying members 5 are provided with proximity members 52 of, for example a polytetrafluoroethylene resin to space a wafer W slightly upward from the carrying members 5; for example, a wafer W is supported at a position at 2 mm above the carrying members 5.

The pair of rotating members 41 and 42 are disposed with their axes of rotation extended along the width of the processing area 2. The rotating members 41 and 42 have a length substantially corresponding to the width of the processing area 2. The rotating member 41 is disposed at a position on the upstream side of the sending-in transfer unit 31. The rotating member 42 is disposed at a position on the downstream side of the sending-out transfer unit 32. Thus the rotating members 41 and 42 are disposed in the opposite end parts of the processing area 2, respectively. The sending-in transfer unit 31 and the sending-out transfer unit 32 are disposed at the upstream and the down stream end, respectively, of the carrying passage formed by the carrying passage forming mechanism 4.

Referring to FIGS. 1 and 2, the rotating member 41 is a driving pulley driven for rotation by a motor M1, and the rotating member 42 is a driven pulley. The timing belts 43 are wound round the opposite longitudinal ends of the rotating members 41 and 42. The pairs of carrying members 5 are arranged at predetermined intervals on the timing belts 43.

The rotating members 41 and 42 are driven for rotation to move the carrying members 5 from the sending-in transfer unit 31 through the processing area 2 to the sending-out transfer unit 32, and to return the carrying members 5 along the orbital path to the sending-in transfer unit 31. FIG. 1 is a perspective view of assistance in explaining the carrying passage forming mechanism 4, in which a mesh belt, and members disposed inside the orbital path along which the timing belts 43 move are omitted for the sake of convenience.

Figure 5:
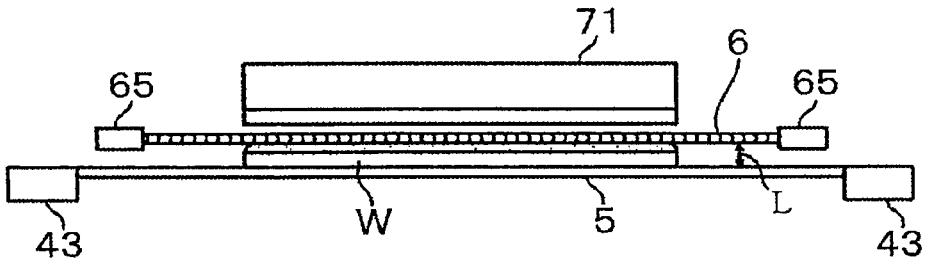
FIG. 5 is a front elevation showing the carrying member, a wafer W and a mesh belt in the developing apparatus shown in FIG. 1.

A mesh belt 6 is extended above a wafer W supported on the carrying members 5 and moving in the processing area 2. The mesh belt 6 moves along a second orbital path in synchronism with the carrying members 5. The mesh belt 6 is a mesh belt of nylon and polytetrafluoroethylene filaments having a thickness on the order of 0.15 mm and having openings of a size on the order of 1.0 mm by 1.0 mm. The mesh belt 6 has a width wide enough to cover a wafer W entirely. As shown in FIG. 5 by way of example, the mesh belt 6 is extended so as to cover the processing area 2 entirely and the distance between the lower surface of the mesh belt 6 and the surface of the carrying members 5 is, for example, on the order of 1.7 mm.

As shown in FIG. 3, the mesh belt 6 is wound round rotating members 61, 62, 63 and 64 respectively having horizontal axes of rotation parallel to each other. The mesh belt 6 moves along the second orbital path. The axes of rotation of the rotating members 61 to 64 are parallel to the width of the processing area 2. The rotating members 61 to 64 have a length equal to the width of the mesh belt 6.

The mesh belt 6 moves without interfering with the external substrate carrying device 33 in a transfer operation to transfer a wafer W to the sending-in transfer unit 31, and the external substrate carrying device 33 in a transfer operation to receive a wafer W from the sending-out transfer unit 32. The rotating member 61 is disposed, for example, at a position on the upstream side of a working area where the substrate carrying device 33 transfers a wafer W to the sending-in transfer unit 31. The rotating member 62 is disposed opposite to the rotating member 61 with respect to the length of the processing area 2, for example, at a position on the upstream side of a working area where a wafer W is transferred from the sending-out transfer unit 32 to the substrate carrying device 33.

The rotating member 63 is disposed above the rotating member 62 opposite to the rotating member 62. The rotating member 64 is disposed above the rotating member 61 opposite to the rotating member 61. For example, the rotating member 61 is a driving pulley driven for rotation by a motor M2 as shown in FIG. 3, and the rotating members 62 to 64 are driven pulleys. Timing belts 65 are wound round the axially opposite ends of the rotating members 61 to 64, respectively. Although the motors M1 and M2 are separated from the rotating members 41 and 61, respectively, for the sake of convenience, actually, the motor M2, similarly to the motor M1 for driving the rotating member 41, is disposed between a pair of driving pulleys and is operatively connected to the pair of driving pulleys.

For example, side edge parts of the mesh belt 6 are attached to the pair of timing belts 145, respectively. The driving pulleys of the rotating member 61 and the driven pulleys of the rotating members 62 to 64 are toothed pulleys. The timing belts 65 are provided with openings, not shown, in which the teeth of the toothed pulleys engage. Thus the toothed pulleys and the timing belts 145 form a feed mechanism.

Operations of the motor M1 for driving the rotating member 41 of the carrying passage forming mechanism 4, and the motor M2 for driving the rotating member 61 for driving the mesh belt 6 for turning are controlled by a controller 31 such that the timing belts 43 of the carrying passage forming mechanism 4, and the timing belts 65 of the mesh belt 6 turn synchronously. Thus the mesh belt 6 moves along the second orbital path in synchronism with the carrying members 5 moving along the first orbital path; that is, the mesh belt 6 and the carrying members 5 are moved simultaneously at the same moving speed, and the adjacent parts of the mesh belt 6 and the carrying members 5 move in the same direction. Therefore, a wafer W can be held so that a developer poured thereon does not drip when the wafer W is moved after pouring the developer onto the wafer W, and the flow of the developer on the wafer W can be suppressed.

A developer pouring nozzle 71 is placed in the developing area 21 to pour the developer through the mesh belt 6 onto a surface of a wafer W when the wafer W supported on the carrying members 5 moves through the developing area 21. The developer pouring nozzle 71 have a developer pouring area of a length approximately equal to or greater than the diameter of a wafer W. The developer pouring nozzle 71 is disposed such that the length of the developer pouring nozzle 71 is parallel to the width of the processing area 2 and the lower end of the developer pouring nozzle 71 is at a distance of about 2 mm from the surface of a wafer W supported on the carrying members 5.

A first cleaning nozzle 72 and a second cleaning nozzle 77 respectively for pouring a cleaning liquid, such as pure water, through the mesh belt 6 onto the upper surface of a wafer W and for pouring the cleaning liquid onto the lower surface of the wafer W when the wafer W supported on the carrying members 5 moves through the cleaning area 22 are placed in the cleaning area 22. Each of the cleaning nozzles 72 and 77 has a cleaning liquid pouring area of a length greater than the diameter of a wafer W and is disposed such that the length thereof is parallel to the width of the processing area 2. The first cleaning nozzle 72 is disposed such that the lower end of the cleaning liquid pouring nozzle 72 is at a distance of about 2 mm from the surface of a wafer W supported on the carrying members 5.

As shown in FIG. 2, the first cleaning nozzle 72, for example, can be moved in directions parallel to the length of the processing area 2 within the cleaning area 22 by a first moving mechanism 73. For example, the first cleaning nozzle 72 can be longitudinally reciprocated several times to clean the surface of a wafer W. The second cleaning nozzle 77 may be fixedly disposed at a suitable position in the cleaning area 22 or may be longitudinally movable along the length of the processing area 2 within the cleaning area 22.

A first gas nozzle 74 is placed in the drying area 23 to blow a gas serving as an air knife, such as dry air or an inert gas such as nitrogen gas, against the upper surface of a wafer W supported on the carrying members 5 and moving through the drying area 23 to dry the upper surface of the wafer W. A second gas nozzle 78 is placed in the drying area 23 to blow the gas against the lower surface of the wafer W. Each of the gas nozzles 74 and 78 has a gas blowing area of a length greater than the diameter of a wafer W and is disposed such that the length thereof is parallel to the width of the processing area 2. The first gas nozzle 74 is disposed such that the lower end of the gas nozzle 74 is at a distance of about 1 mm from the surface of a wafer W supported on the carrying members 5. As shown in FIG. 2, the first gas nozzle 74, for example, can be moved in directions parallel to the length of the processing area 2 within the drying area 23 by a second moving mechanism 75. The second gas nozzle 78 may be fixedly disposed at a suitable position in the drying area 23 or may be longitudinally movable along the length of the processing area 2 within the drying area 23.

The developer pouring nozzle 71, the first cleaning nozzle 72, the second cleaning nozzle 77, the first gas nozzle 74 and the second gas nozzle 78 are arranged, for example, in a space surrounded by the second orbital path along which the mesh belt 6 moves, and are connected so as not to obstruct the movement of the mesh belt 6 along the orbital path by supply lines 71*a*, 72*a* and 74*a* respectively provided with flow regulating valves V1 to V3 to a developer supply unit 71*b*, a cleaning liquid supply unit 72*b* and a drying gas supply unit 74*b*, respectively. The flow regulating valves V1 to V3 are controlled by the controller 110.

A liquid container 75 is disposed in the developing area 21 and the cleaning area 22 under the carrying members 5 to recover the developer and the cleaning liquid supplied into the developing area 21 and the cleaning area 22. In this embodiment, the liquid container 75 is placed in a space surrounded by the first orbital path along which the carrying members 5 move below the second cleaning nozzle 72. A drain line 75*a* is connected to the liquid container 75 so as not to obstruct the movement of the carrying members 5 along the orbital path.

The drying area 23 is surrounded by a processing vessel 76 to promote drying a wafer W. The processing vessel 76 surrounds a wafer W when the wafer W moves through the drying area 23. Slits 76*a* are formed in parts of the processing vessel 76 corresponding to the passage of a wafer W so that the wafer W supported on the carrying members 5 can move through the processing vessel 76. An exhaust line 76*b* has one end connected to the processing vessel 76 so that the exhaust line 76*b* may not obstruct the movement of the carrying members 5 along the orbital path, and the other end connected to an exhaust pump 76*c*. The controller 110 controls the exhaust pump 76*c* to maintain the interior of the processing vessel 76 at a negative pressure. Thus the mesh belt 6 and a wafer W are simultaneously cleaned and dried.

The sending-in transfer unit 31 is provided with a first lifting pin mechanism 81 disposed, for example, inside the first orbital path along which the carrying members 5 move. The first lifting pin mechanism 81 is used for transferring a wafer W from the substrate carrying device 33 to the carrying members 5. Lifting pins 82 are vertically movable. When the substrate carrying device 33 is located at a transfer position where a wafer W is transferred from the substrate carrying device 33 to the sending-in transfer unit 31, the lifting pins 82 rise through spaces between the carrying members 5 and spaces surrounded by the holding members 33*a* of the substrate carrying device 33 to a level above the holding members 33*a*, and move down to a level below the carrying members 5 after the wafer W has been placed on the carrying members 5.

The sending-out transfer unit 32 is the same in construction as the sending-in transfer unit 31. For example, the sending-out transfer unit 32 is provided with a second lifting pin mechanism 83 disposed inside the first orbital path along which the carrying members 5 move for transferring a wafer W from the carrying members 5 to the substrate carrying device 33. The second lifting pin mechanism 83, similarly to the first lifting pin mechanism 81, is provided with vertically movable lifting pins 84. In FIG. 3, indicated at 85 is a base plate on which the first lifting pin mechanism 81 and the second lifting pin mechanism 83 are mounted.

The controller 110 including a computer and included in the developing apparatus manages a developing process recipe to be carried out by the developing apparatus, and controls transfer operations of the substrate carrying device 33, pouring the developer and the cleaning liquid respectively through the developer pouring nozzle 71 and the cleaning nozzle 72, blowing the drying gas through the gas nozzle 74, and driving the carrying passage forming mechanism 4 and the mesh belt 6. The controller 110 has a storage device storing, for example, a computer program, namely, a piece of software including a set of instructions specifying steps of a developing process to be carried out by the developing apparatus. The controller 110 reads the computer program from the storage device to control the general operations of the developing apparatus. The computer program is stored in a storage medium, such as a flexible disk, a hard disk, a compact disk, a magnetooptical disk or a memory card. The storage medium is held in the storage device.

Figure 6A:
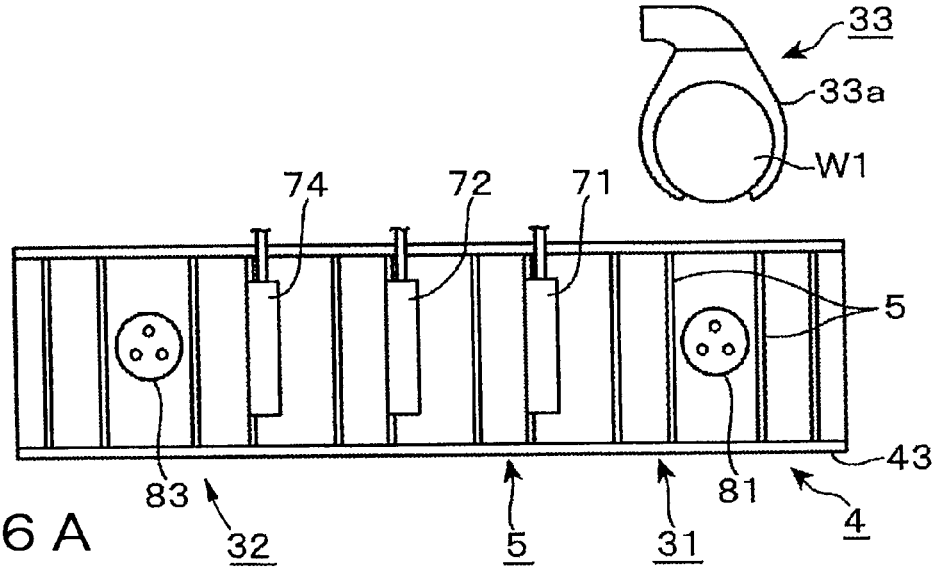
FIGS. 6A, 6B and 6C are schematic plan views of assistance in explaining operations of the developing apparatus shown in FIG. 1.
Figure 6B:
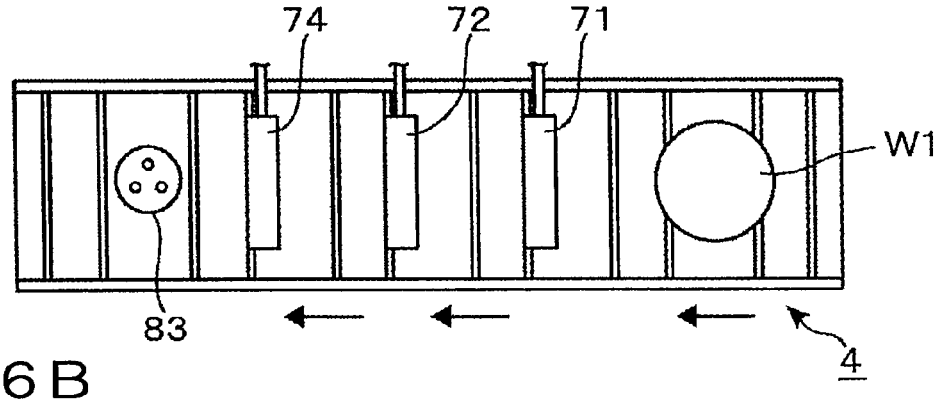

A developing process to be carried out by the developing apparatus will be described with reference to FIGS. 6 and 7. Referring to FIGS. 6A and 6B, the carrying members 5 are stopped and held stationary at a transfer position, and then a wafer W1 is transferred from the substrate carrying device 33 to the sending-in transfer unit 31. At the transfer position, the substrate can place the wafer W1 at a predetermined position on the two adjacent carrying members 5, and the first lifting pin mechanism 81 of the sending-in transfer unit 31 is located between the two adjacent carrying members 5.

The wafer W1 is transferred from the substrate carrying device 33 to the two carrying members 5, for example, by locating the substrate carrying device 33 above the sending-in transfer unit 31, raising the lifting pins 82 of the lifting pin mechanism 81 to a level above the carrying members 5 to transfer the wafer W1 from the substrate carrying device 33 to the lifting pins 82, and lowering the lifting pins 18 to a level below the carrying members 5 after the substrate carrying device 33 has been retracted to transfer the wafer W1 to the carrying members 5.

Figure 6C:
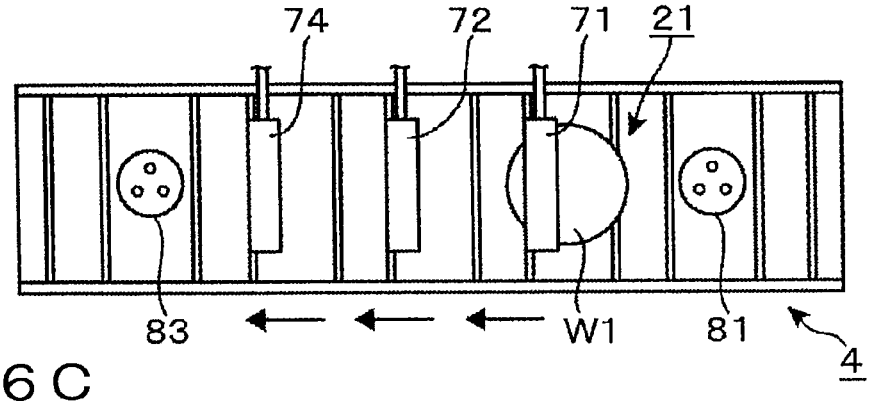

After the wafer W1 has been placed on the carrying members 5, the motors M1 and M2 are actuated to move the carrying members 5 and the mesh belt 6 toward the processing area 2 at a predetermined speed. As shown in FIG. 6C, the developer is poured at a predetermined pouring rate through the developer pouring nozzle 71 onto a surface of the wafer W1 through the mesh belt 6 while the wafer W1 is being moved in the developing area 21. Although the developer pouring nozzle 71 is stationary, the developer can be poured on the entire surface of the wafer W1 because the wafer W1 moves. Thus the developing process is carried out. In FIGS. 6 and 7, the mesh belt 6, and the processing vessel 76 disposed in the drying area 23 are omitted for the sake of convenience.

Figure 7A:
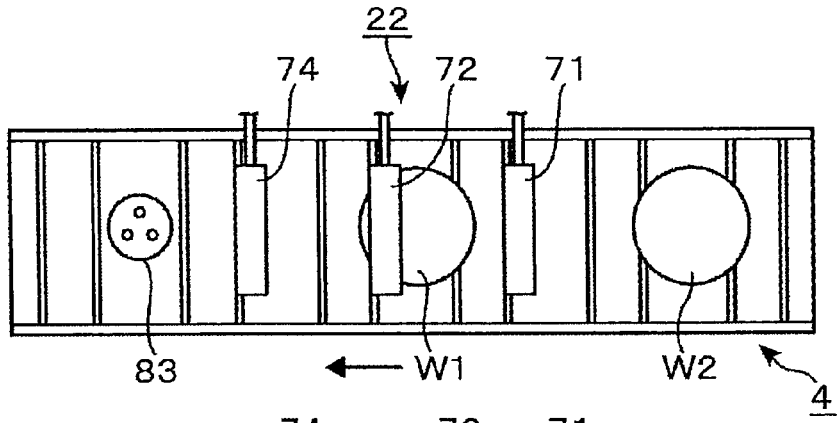
FIGS. 7A, 7B, 7C and 7D are schematic plan views of assistance in explaining operations of the developing apparatus shown in FIG. 1.

As shown in FIG. 7A, the wafer W1 wetted with the developer is moved to the cleaning area 22. The developer covering the surface of the wafer W1 is held between the wafer W1 and the mesh belt 6 while the wafer W1 is being moved to the cleaning area 22. The length of the developing area 21 with respect to a direction in which the wafer W1 is moved may be adjusted, the moving speed of the wafer W1 may be controlled or the wafer W1 may be kept stationary for some time after wetting the surface of the wafer W1 with the developer to ensure a predetermined developing time on the order of 60 s.

After the passage of a predetermined developing time, the first cleaning nozzle 72 pours the cleaning liquid at a predetermined pouring rate through the mesh belt 6 onto the upper surface of the wafer W1 to wash the developer away from the upper surface of the wafer W1 and the mesh belt 6. The second cleaning nozzle 72 spouts the cleaning liquid against the lower surface of the wafer W1 to wash away the developer wetting the lower surface of the wafer W1. The first cleaning nozzle 72 pours the cleaning liquid, moving in the moving direction of the wafer W1 in the cleaning area 22. In this cleaning process, the length of the cleaning area 22 with respect to the moving direction of the wafer W1 may be adjusted, the cleaning liquid pouring rate may be adjusted or the moving speed of the wafer W1 may be controlled to ensure that the wafer W1 is perfectly cleaned. The wafer W1 may be stopped temporarily while the cleaning liquid is being poured or after the cleaning liquid has been poured. In FIG. 7, a wafer W2 is a wafer succeeding the wafer W1, and a wafer W3 is a wafer succeeding the wafer W2. Thus wafers W are successively transferred from the substrate carrying device 33 to the sending-in transfer unit 31 at predetermined intervals.

Figure 7B:
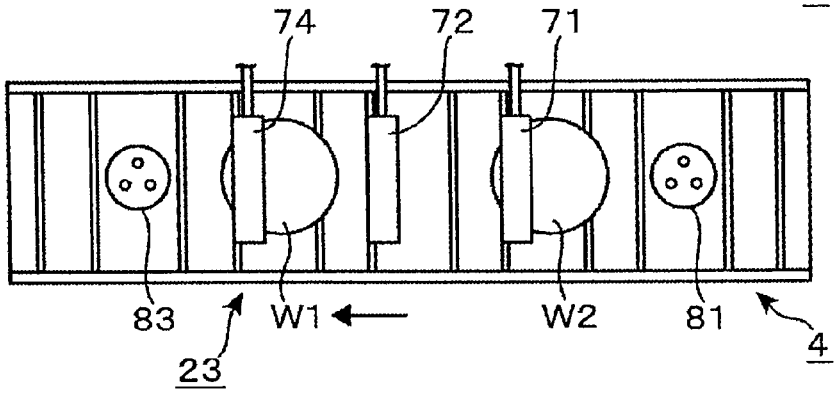

Then, the wafer W1 is moved into the drying area 23 as shown in FIG. 7B. The surfaces of the wafer W1 processed by a cleaning process is dried while the wafer W1 is moving in the processing vessel 76 evacuated at a negative pressure. The first gas nozzle 74 blows the drying gas at a predetermined rate through the mesh belt 6 against the upper surface of the wafer W1 to dry the upper surface of the wafer W1 and the mesh belt 6. The second gas nozzle 78 blows the drying gas against the lower surface of the wafer W1 to dry the lower surface of the wafer W1.

The first gas nozzle 74 blows the drying gas against the upper surface of the wafer W1, moving in the processing vessel 76 in the moving direction of the wafer W1. In this drying process, the length of the drying area 23 with respect to the moving direction of the wafer W1, the pressure in the processing vessel 76 may be adjusted, a desired number of gas nozzles like the gas nozzle 74 may be used or the moving speed of the gas nozzle 74 may be controlled to ensure that the surfaces of the wafer W1 are perfectly dried.

Figure 7C:
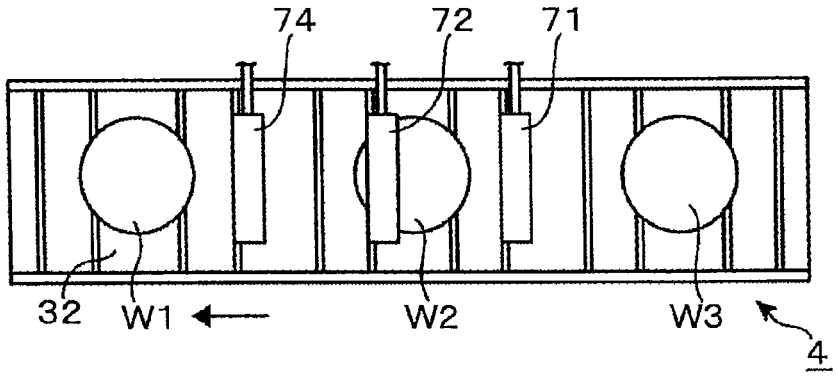
Figure 7D:
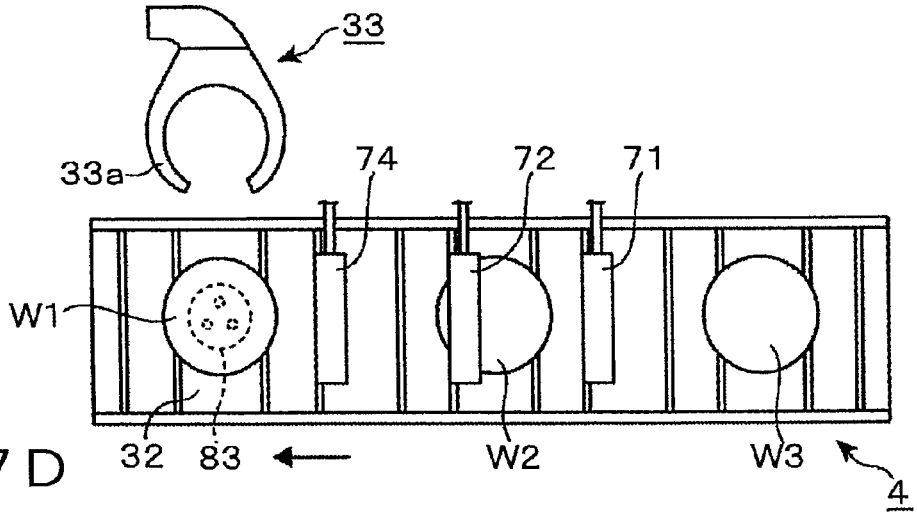

Then, the wafer W1 is moved to the sending-out transfer unit 32 as shown in FIG. 7C and is transferred to the substrate carrying device 33. The carrying members 5 are moved to and located at a transfer position, where the lifting pin mechanism 83 of the sending-out transfer unit 32 is between the two adjacent carrying members 5 as shown in FIG. 7D.

For example, the lifting pins 84 of the lifting pin mechanism 83 are raised from below the carrying members 5 supporting the wafer W1 thereon to transfer the wafer W1 from the carrying members 5 to the lifting pins 84, the substrate carrying device 33 is advanced into a space between the carrying members 5 and the lifting pins 84, the substrate carrying device 33 is raised to transfer the wafer W1 from the lifting pins 84 to the substrate carrying device 33, the substrate carrying device 33 supporting the wafer W1 is retracted, and then the lifting pins 84 are lowered to a level below the carrying members 5. After the wafer W1 has been transferred to the substrate carrying device 33, the carrying members 5 are returned to the sending-in transfer unit 31.

The developing apparatus can achieve a high throughput. The wafers W not yet processed by the developing process are transferred successively from the substrate carrying device 33 to the sending-in transfer unit 31 at predetermined intervals in the developing apparatus. The developer is poured onto the surface of the wafer W in the developing area 21, the developer is washed away from the surface of the wafer W in the cleaning area 22, and the surfaces of the wafer W is dried in the drying area 23 while the wafer W thus transferred to the sending-in transfer unit 31 moves from the upstream end toward the down stream end of the processing area 2. The wafer W thus processed is transferred to the sending-out transfer unit 32. The wafers W processed by the developing process are delivered successively to the sending-out transfer unit 32 at predetermined intervals, and then, the wafers W processed by the developing process are transferred from the sending-out transfer unit 32 to the substrate carrying device 33 at predetermined intervals. The size of the processing area 2 is designed such that three wafers W can be arranged in the moving direction in the processing area 2, and hence the size of the developing apparatus is approximately equal to the size of a developing unit formed by laterally arranging three conventional developing apparatuses. Times needed for completing the developing process, the cleaning process and the drying process by the developing apparatus are equal to those needed by the developing unit including the three laterally arranged conventional developing apparatus, and the time needed for completing the developing process is rate controlling time. Therefore, the developing apparatus of the present invention can process wafers W at a throughput higher than the total throughput of the three conventional developing apparatuses, when wafers W are carried through the sending-in transfer unit 31 into the developing apparatus at intervals corresponding to the time needed to complete the developing process.

The developing apparatus of the present invention can achieve such a high throughput because the developing apparatus processes wafers W while the wafers W are moving, and the wafers W are continuously subjected to the developing process by sending wafers W successively into the developing apparatus through the sending-in transfer unit 31 at the predetermined intervals. When the three conventional developing apparatuses are used, the substrate carrying device 33 needs to carry out operations for carrying a processed wafer W out from each of the three processing apparatuses and for carrying a wafer W to be processed into each of the three developing apparatuses. Since the developing process cannot be executed during those operations, which reduces the throughput.

The substrate carrying device carries a wafer W to and receives the wafer W from each conventional developing apparatuses. Therefore, the substrate carrying device needs to access three points when the three conventional developing modules are arranged. On the other hand, the developing apparatus of the present invention has the sending-in transfer unit 31 and the sending-out transfer unit 32, and hence the substrate carrying device 33 needs to access two points. Therefore, load on the substrate carrying device 33 is small, which improves the throughput.

The developing apparatus may be provided with two substrate carrying devices 33A and 33B, and the substrate carrying devices 33A and 33B may operate individually to carry out a wafer W from the developing apparatus and to carry a wafer W into the developing apparatus, respectively, to reduce loads on the substrate carrying devices 33A and 33B still further. The substrate carrying devices 33A and 33B do not need to move in the direction along the length of the processing area 2, namely, the Y-direction, the carrying time is reduced by a time needed to move the substrate carrying devices 33A and 33B in the Y-direction. The substrate carrying device 33A operates exclusively for carrying in a wafer W, and the substrate carrying device 33B operates exclusively for carrying out a wafer W. Thus the number of steps of work of the substrate carrying devices 33A and 33B is smaller than that needed when the substrate carrying device 33 needs to carry a processed wafer W out from the developing module and to carry a wafer to be processed into the developing apparatus.

Even if two carrying devices are used for the conventional developing apparatus to transfer a wafer W, the number of steps of work to be carried out by the two carrying devices is larger than that to be carried out by the substrate carrying device 33 in the developing apparatus of the present invention because the conventional developing apparatus has many points to be accessed by the carrying devices, and a wafer W needs to be carried into the developing apparatus after carrying out a processed wafer W from the developing apparatus. Thus the load on the conventional carrying devices is greater than that on the substrate carrying device 33 of the present invention.

The developing apparatus is provided with the mesh belt 6, the developer is held between a wafer W and the mesh belt 6 while the wafer W moves. The wafer W and the mesh belt 6 move synchronously at the same moving speed. Consequently, the flow of the developer on the wafer W can be suppressed by the mesh belt 6, the partial collection of the developer in a part of the surface of the wafer W and the dripping of the developer from the wafer W can be suppressed even if the wafer W is moved, the surface of the wafer W can be uniformly processed by the developing process.

Figure 8:
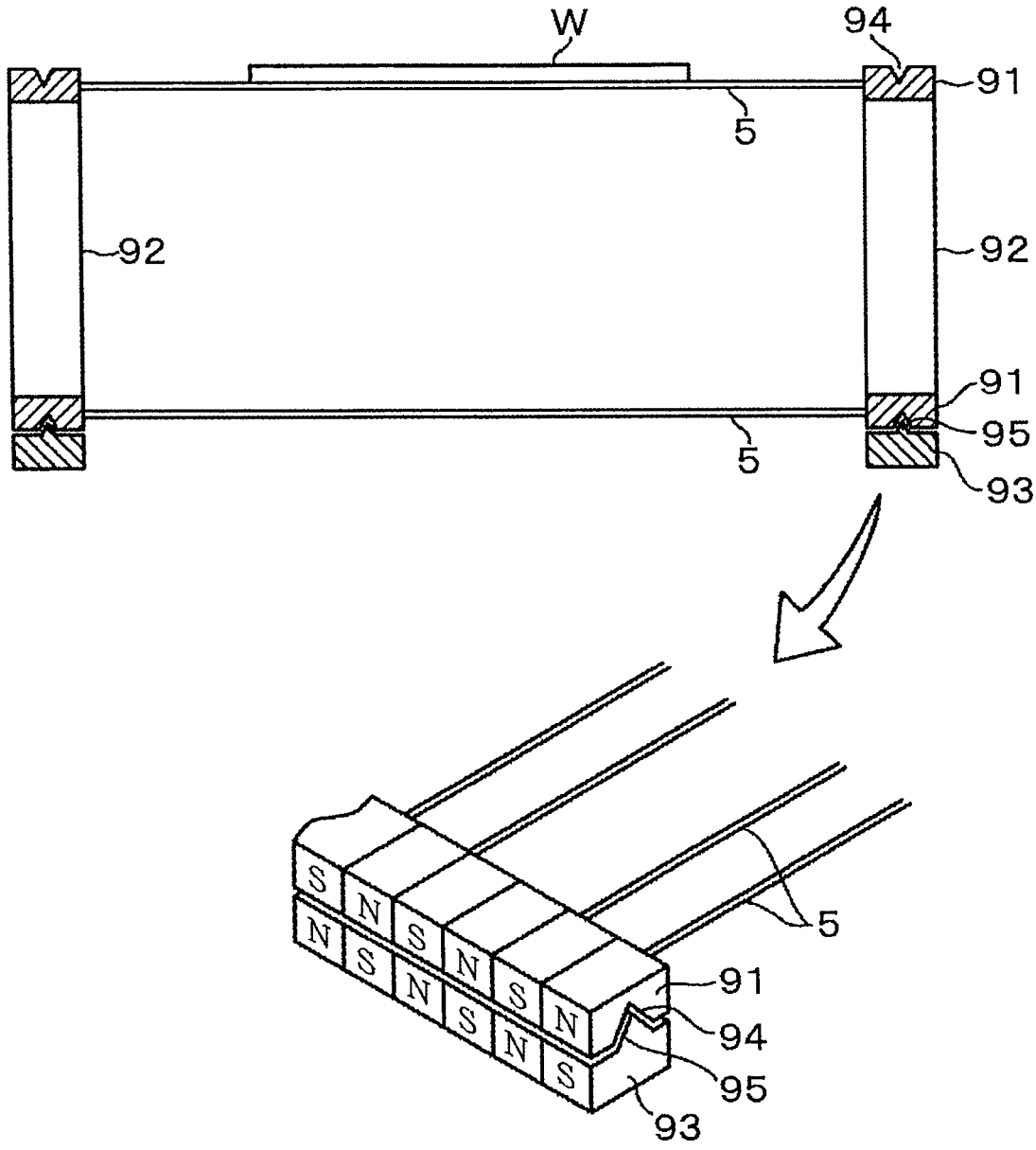
FIG. 8 is a plan view and a perspective view of a carrying passage forming mechanism in a developing apparatus in a second embodiment according to the present invention.

A developing apparatus in a second embodiment according to the present invention will be described with reference to FIG. 8. The second embodiment differs from the first embodiment in that timing belts 91 holding carrying members 5 are moved by linear motors along first orbital paths, respectively. The second embodiment is provided with first pulleys 92 instead of the drive pulleys of the rotating member 41, second pulleys, not shown, instead of the driven pulleys of the rotating member 42. The timing belts 91 are extended between the first pulleys 92 and the second pulleys. The sizes and positions of the first pulleys 92 and the second pulleys are equal to those of the rotating members 41 and 42 of the carrying passage forming mechanism 4.

The timing belts 91 are provided at least on the outer surfaces thereof with electromagnets arranged such that N poles and S poles are arranged alternately. Driving electromagnets 93 for driving the timing belts 91 are arranged in parts, such as lower straight parts, of the first orbital paths of the timing belts 91. The driving electromagnets 93 are slightly spaced apart from the timing belts 91 when the timing belts 91 are moved. The polarities of the driving electromagnets 93 are changed such that N poles and S poles are arranged alternately. The controller 110 controls switching the polarities.

V-shaped grooves 94 are formed in the surfaces of the timing belt 91 facing the driving electromagnets 93, respectively. V-shaped projections 95 conforming to the V-shaped grooves 94 of the timing belts 91 are formed in the surfaces of the driving electromagnets 93 facing the timing belts 91, respectively.

The driving electromagnets 193 are energized, and the polarities of the driving electromagnets 93 are switched to float the timing belts 91 slightly above the driving electromagnets 93, and the first and the second pulleys are rotated to move the timing belts 91 respectively along the first orbital paths.

Figure 9:
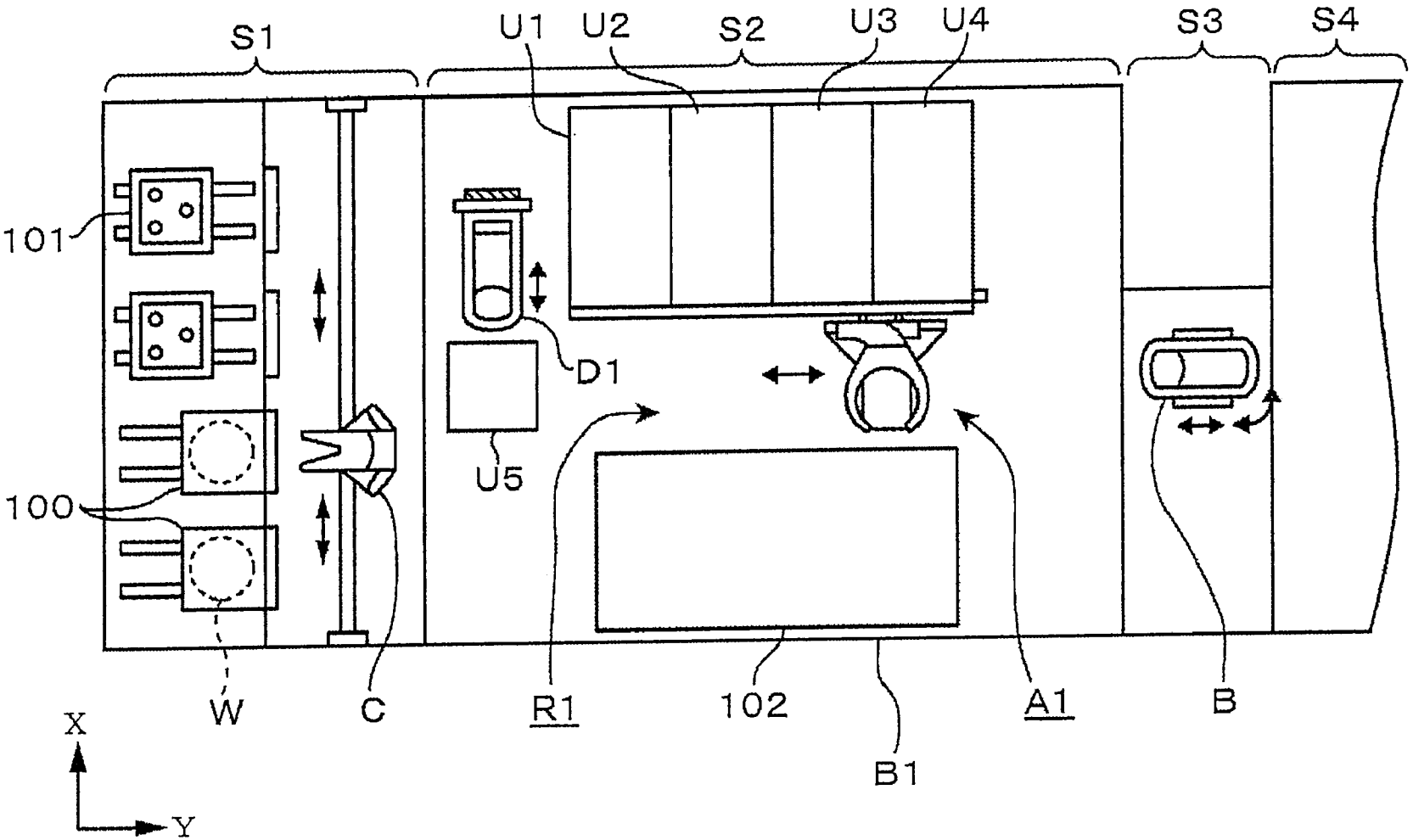
FIG. 9 is plan view of a resist pattern forming system provided with the developing apparatus shown in FIG. 1.
Figure 10:
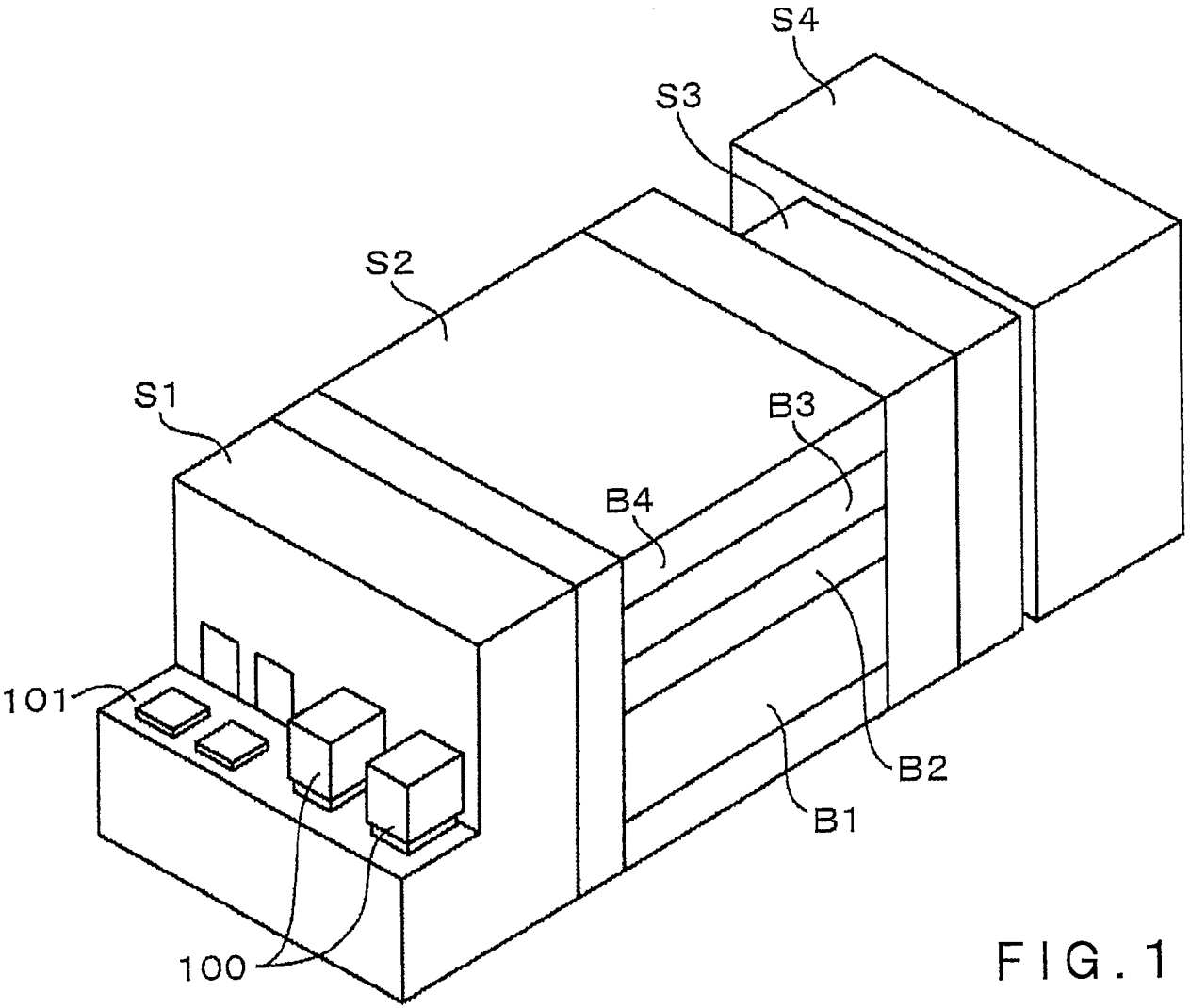
FIG. 10 is a perspective view of the resist pattern forming system shown in FIG. 9.

A resist film forming system built by connecting an exposure system to a coating and developing system including the foregoing developing apparatus will be briefly described. FIG. 9 is plan view of the resist pattern forming system and FIG. 10 is a perspective view of the resist pattern forming system shown in FIG. 9. The resist pattern forming system has a carrier block S1 and a processing block S2 adjacent to the carrier block S1. A transfer arm C takes out a wafer W from an airtight carrier 100 placed on a platform 101 in the carrier block and transfers the wafer W to the processing block S2. The transfer arm C receives a wafer W processed by the processing block S2 and returns the wafer W to the carrier 100.

Figure 11:
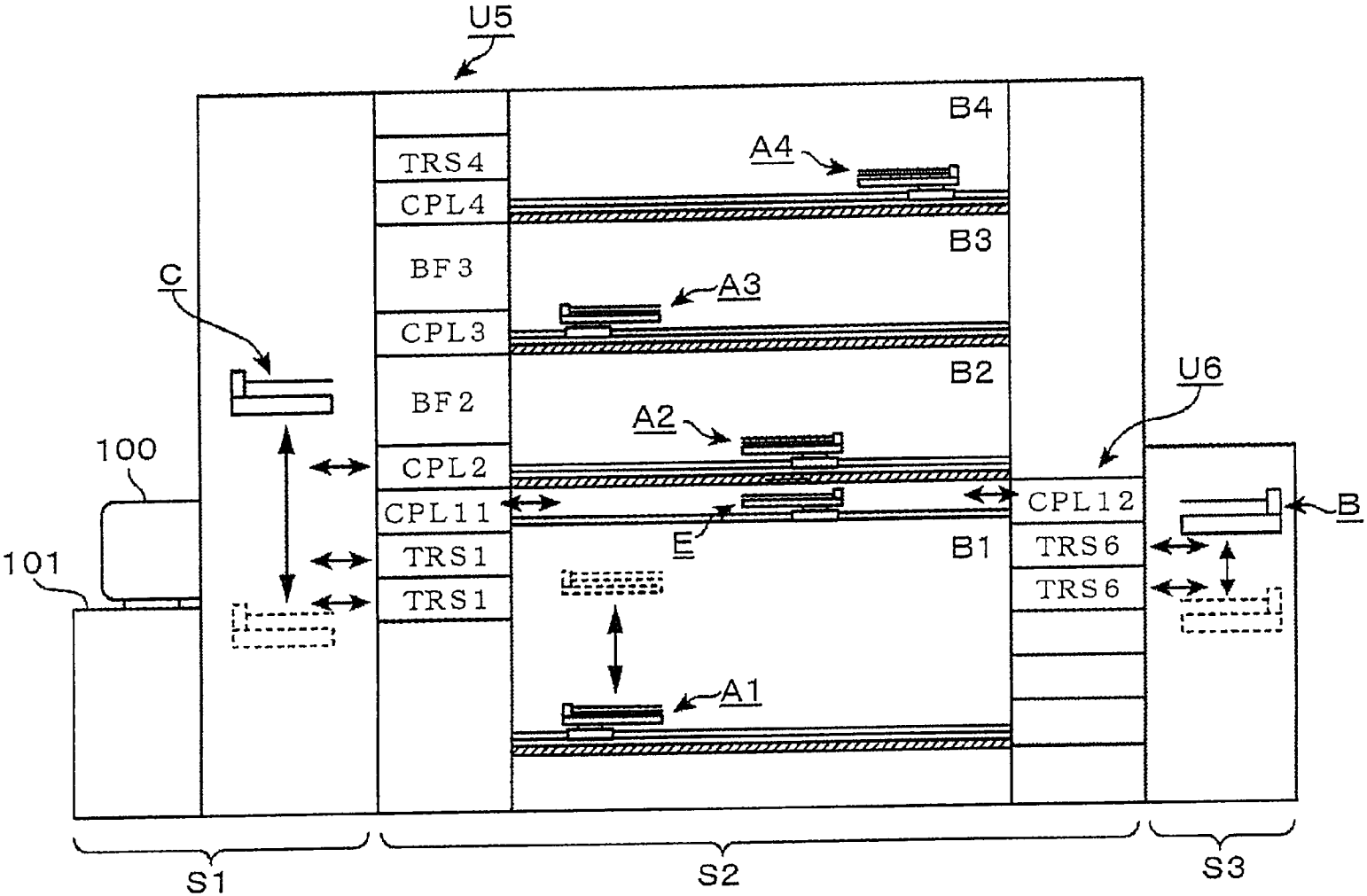
FIG. 11 is a side elevation of the resist pattern forming system shown in FIG. 9.
Figure 12:
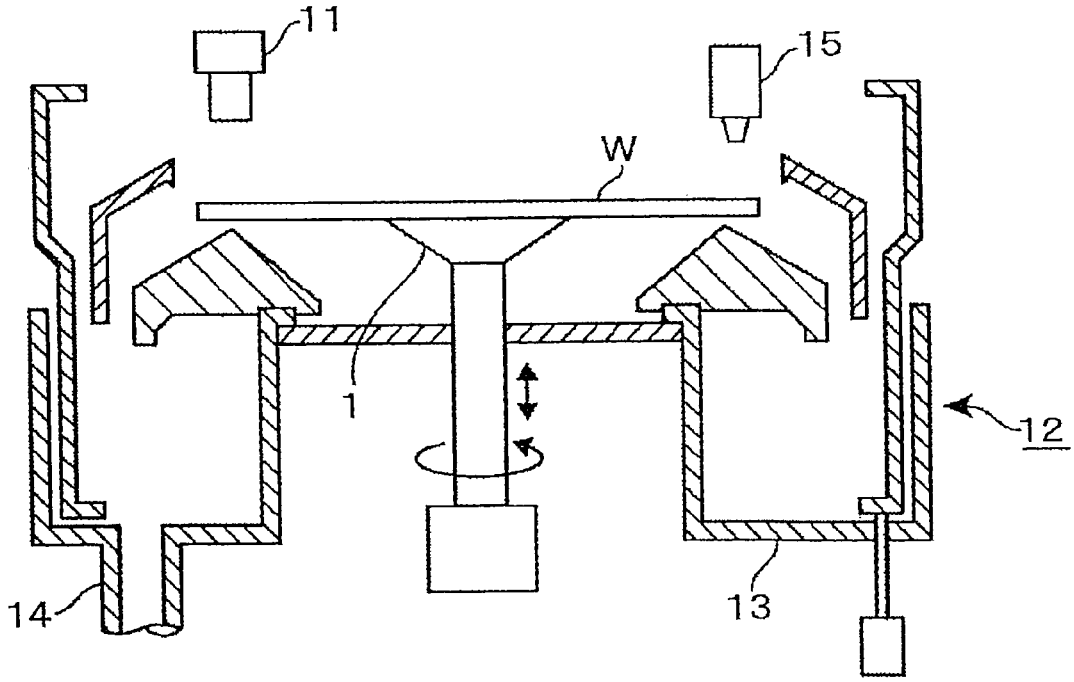
FIG. 12 Related Art
FIG. 12 is a side elevation of a known developing apparatus.

Referring to FIGS. 10 and 11, the processing block S2 is built by stacking up a first block B1 (DEV layer), a second block B2 (BCT layer) for forming an antireflection film underlying a resist film, a third block B3 (COT layer) for carrying out a coating process to apply a resist solution to a wafer W, and a fourth block B4 (TCT layer) for forming an antireflection film overlying a resist film upward in that order.

Each of the second block B2 (BCT layer) and the fourth block B4 (TCT layer) includes a coating module for coating a surface of a wafer W with a chemical solution for forming an antireflection film by a spin-coating method, heating and cooling modules for processing a wafer W by pretreatment processes before the wafer W is processed by the coating unit and by posttreatment processes after a wafer has been processed by the coating process, and carrying arms A2 and A4 for carrying a wafer among those coating module and processing modules. The third block B3 (COT layer) is similar to the second block B2 (BCT layer) and the fourth block B4 (TCT layer), except that the third block B3 (COT layer) uses a resist solution and has a coating module for coating a surface of a wafer W with a resist solution.

The first processing block B1 (DEV layer) has, for example, two developing units 102 respectively including two developing apparatuses of the present invention and stacked in two layers, and a carrying arm A1 for carrying a wafer w to the two developing units 102. The carrying arm A1 is used for carrying a wafer W to the two developing units 102. Each of the first block B1 to the fourth block B4 is provided with heating and cooling processing modules including a heating module for heating a wafer W and a cooling module for cooling a wafer w.

Referring to FIGS. 9 and 11, a shelf unit U5 is disposed in the processing block S2. A first transfer arm D1 carries a wafer W to and receives a wafer W from the modules of the shelf unit U5. The transfer arm D1 can move forward and backward and can move in vertical directions.

The transfer arm C transfers wafers W successively from the carrier block S1 to, for example, a transfer module CPL2 corresponding to the second block B2 (BCT layer). The carrying arm A2 of the second block B2 (BCT layer) receive a wafer W from the transfer module CPL2 and carries the wafer to the processing modules including the antireflection film forming module and the heating and cooling modules to form an antireflection film on the wafer W.

Then, the wafer W is carried along a route passing a transfer module i, the transfer arm D1, a transfer module CPL3 of the shelf unit U5, and a carrying arm A3 to the third block B3 (COT layer) to form a resist film on the wafer W. Then, the carrying arm A3 carries the wafer W to a transfer module BF3 of the shelf unit U5. In some cases, another antireflection film is formed in the fourth block b4 (TCT layer) on the resist film formed on the wafer W. When another antireflection film is to be formed on the resist film formed on the wafer W, the transfer arm D1 transfers the wafer W from the transfer module BF3 to a transfer module CPL4, and a carrying arm A4 receives the wafer W from the transfer module CPL4. After another antireflection film has been formed on the resist film, the carrying arm A4 carries the wafer W to a transfer module TRS4.

A shuttle arm E is installed in an upper part of the DEV layer B1. The shuttle arm E1 is used exclusively for directly carrying a wafer W from a transfer module CPL11 of the shelf unit U5 to a transfer module CPL12 of a shelf unit U6. The transfer arm D1 carries the wafer W provided with the resist film and the antireflection film from the transfer module BF3 or the wafer W provided with the resist film and the antireflection film from the transfer module TRS4 to the transfer module CPL11. Then, the shuttle arm E carries the wafer W directly from the transfer module CPL11 to the transfer module CPL12 of the shelf unit U6. Then, the wafer W is transferred to an interface block S3. The transfer modules indicated by marks including a symbol CPL serve also as cooling modules for adjusting the temperature of a wafer W. The transfer modules indicated by marks including a symbol BF serve also as buffer modules capable of holding a plurality of wafers W.

Subsequently, an interface arm B carries the wafer W from the interface block S3 to an exposure system S4. The exposure system S4 processes the wafer W by a predetermined exposure process. The wafer W processed by the exposure process is transferred to a transfer module TRS6 of the processing block S2. Then, the wafer W is subjected to a developing process in the first block B1 (DEV layer). The carrying arm A1 carries the wafer W processed by the developing process to a transfer module of the shelf unit U5 accessible by the transfer arm C. Then, the transfer arm C returns the wafer W to the carrier 100. Units U1 to U4 shown in FIG. 9 are thermal units built by stacking up heating modules and cooling modules.

The size of the processing area 2 and the construction of the developing apparatus of the present invention is not limited to the size and construction mentioned above, provided that the carrying passage forming mechanism 4 forming the carrying passage along which a wafer W is carried turn along the orbital path, the sending-in transfer unit 31 is disposed at the upstream end of the carrying passage, the sending-out transfer unit 32 is disposed at the downstream end of the carrying passage, and the developer pouring nozzle 71, the cleaning nozzle 72 and the gas nozzle 74 are arranged in that order between the upstream end and the downstream end of the carrying passage in the direction in which a wafer W is carried. The mesh belt 6 and the processing vessel 76 are not necessarily indispensable. The carrying members 5 and the mesh belt 6 may be moved along the orbital paths, respectively, by any suitable driving mechanisms other than those mentioned above.

The present invention is applicable not only to a coating and developing system including a coating module for coating a surface of a substrate with a resist solution and a developing module for processing a substrate processed by an exposure process by a developing process included in different processing unit blocks, respectively, but also to a coating and developing system including a coating module and a developing module in the same area in a processing block. The present invention is applicable not only to a processing semiconductor wafers W, but also to processing substrates, such as LCD substrates and mask substrates, other than semiconductor wafers W.

What is claimed is:

1. A developing apparatus, to which a substrate carrying means delivers a substrate coated with a solution, processed by an exposure process and to be processed by a developing process, comprising:

a pair of rotating members disposed longitudinally opposite to each other such that the respective axes of rotation thereof are parallel to each other and horizontal;

a carrying passage forming mechanism extended between the pair of rotating members so as to move along an orbital path and forming a carrying passage along which a substrate placed thereon is carried;

a sending-in transfer unit disposed at an upstream end of the carrying passage to transfer a substrate from the substrate carrying means to the carrying passage forming mechanism;

a sending-out transfer unit disposed at a downstream end of the carrying passage to transfer a substrate from the carrying passage forming mechanism to the substrate carrying means; and a developer pouring nozzle for pouring a developer onto a substrate, a cleaning nozzle for pouring a cleaning liquid onto a substrate and a gas nozzle for blowing a gas against a substrate arranged in that order in a direction in which a substrate mounted on the carrying passage forming mechanism moves.

2. The developing apparatus according to claim 1, wherein the carrying passage forming mechanism includes a plurality of bar-shaped carrying members extended parallel to the axes of rotation of the rotating members to support a substrate thereon, and a pair of timing belts connected to the opposite ends of each of the carrying members, respectively, and movable along the orbital path.

3. The developing apparatus according to claim 2 further comprising a motor for driving at least one of the pair of rotating members for rotation to move the timing belts along the orbital path.

4. The developing apparatus according to claim 3 further comprising a mesh belt disposed between a substrate on the carrying passage and the developer pouring nozzle and capable of moving in synchronism with the movement of the substrate.

5. The developing apparatus according to claim 2, wherein the timing belts of the carrying passage forming mechanism are provided at least in their outer surfaces with electromagnets arranged such that N poles and S poles are arranged alternately, and driving electromagnets having changeable magnetic properties for moving the timing belts along the orbital path are arranged such that N poles and S poles are arranged alternately.

6. The developing apparatus according to claim 5 further comprising a mesh belt disposed between a substrate on the carrying passage and the developer pouring nozzle and capable of moving in synchronism with the movement of the substrate.

7. The developing apparatus according to claim 2 further comprising a mesh belt disposed between a substrate on the carrying passage and the developer pouring nozzle and capable of moving in synchronism with the movement of the substrate.

8. The developing apparatus according to claim 1 further comprising a motor for driving at least one of the pair of rotating members for rotation to move timing belts along the orbital path.

9. The developing apparatus according to claim 8 further comprising a mesh belt disposed between a substrate on the carrying passage and the developer pouring nozzle and capable of moving in synchronism with the movement of the substrate.

10. The developing apparatus according to claim 1, wherein timing belts of the carrying passage forming mechanism are provided at least in their outer surfaces with electromagnets arranged such that N poles and S poles are arranged alternately, and driving electromagnets having changeable magnetic properties for moving the timing belts along the orbital path are arranged such that N poles and S poles are arranged alternately.

11. The developing apparatus according to claim 10 further comprising a mesh belt disposed between a substrate on the carrying passage and the developer pouring nozzle and capable of moving in synchronism with the movement of the substrate.

12. The developing apparatus according to claim 1 further comprising a mesh belt disposed between a substrate on the carrying passage and the developer pouring nozzle and capable of moving in synchronism with the movement of the substrate.

13. A coating and developing system comprising:

a carrier block to which a carrier containing a plurality of substrates is delivered and from which a carrier containing a plurality of substrates is sent out;

a processing block including coating units for coating a surface of a substrate with a resist solution, heating units for heating a substrate, cooling units for cooling a heated substrate, and developing units for processing a substrate processed by an exposure process by a developing process;

an interface block through which a substrate is transferred between the processing block and an exposure system;

wherein each of the developing units includes the developing apparatus set forth in claim 1.

14. A developing method of processing a substrate having a surface coated with a solution and processed by an exposure process and carried by a substrate carrying means by a developing apparatus, said developing method comprising the steps of:

forming a substrate carrying passage along which a substrate supported on a carrying passage forming mechanism extended between a pair of rotating members disposed longitudinally opposite to each other with their axes of rotation extended parallel to each other, and movable along an orbital path is carried;

transferring a substrate from the substrate carrying means through a sending-in transfer unit disposed at an upstream end of the carrying passage to the carrying passage forming mechanism;

pouring a developer onto the substrate while the substrate is being moved downstream by moving the carrying passage forming mechanism;

pouring a cleaning liquid onto the substrate while the substrate is being moved downstream by the carrying passage forming mechanism;

blowing a dry gas against the substrate while the substrate is being moved downstream by the carrying passage forming mechanism;

transferring the substrate from the carrying passage forming mechanism through a sending-out transfer unit disposed at a downstream end of the carrying passage to the substrate carrying means; and moving the carrying passage forming mechanism not supporting any substrate from the sending-out transfer unit to the sending-in transfer unit along the orbital path.

15. A non-transitory storage medium storing a computer program to be executed by a developing apparatus that processes a substrate having a surface coated with a solution and processed by an exposure process by a developing process;

wherein the computer program is a set of instructions specifying the steps of the developing method set forth in claim 14.

* * * * *